United States Patent [19]

Rabinow

[11] Patent Number: 4,796,447

[45] Date of Patent: Jan. 10, 1989

[54] LOCK WITH KEY ISOLATION USING TRANSFER TUMBLERS

[76] Inventor: Jacob Rabinow, 6920 Selkirk Dr., Bethesda, Md. 20817

[21] Appl. No.: 71,417

[22] Filed: Jul. 9, 1987

[51] Int. Cl.[4] ..... E05B 29/02

[52] U.S. Cl. ..... 70/495; 70/419

[58] Field of Search ..... 70/495, 492, 419, 376, 70/377, 378, 421

[56] References Cited

U.S. PATENT DOCUMENTS 4,485,640 12/1984 Rabinow ..... 70/419

4,599,877 7/1986 Rabinow ..... 70/495

*Primary Examiner*—Robert L. Wolfe

*Attorney, Agent, or Firm*—Hall, Myers & Rose

[57] ABSTRACT

This specification describes a lock where a key is inserted into a key cylinder and where the key sets a series of transfer tumblers. The tumblers project from the key cylinder, and the tumblers, in turn, set a series of lock opening elements into their prescribed positions. As the key-cylinder is rotated the transfer tumblers are moved out of contact with the elements. Only at this time can the lock be opened, provided that the elements had been correctly set.

27 Claims, 3 Drawing Sheets

LOCK WITH KEY ISOLATION USING TRANSFER TUMBLERS

BACKGROUND OF THE INVENTION

This invention relates to pick-proof locks where a key sets a series of lock-controlling elements and is then isolated from these elements. At the same time, the lock entrance keyslot is also isolated from the lock-controlling elements. This makes it impossible for any picking tool to reach the lock-opening mechanism thru the key slot.

The general philosophy of this lock follows the basic concepts embodied in the U.S. Pat. No. 4,599,877 issued to me on July 15, 1986. In that patent it was the key itself that set the lock opening elements into their prescribed positions. The key and the key passage were then isolated from the elements before the lock could be opened. The resulting designs were rather complicated and there was the additional difficulty that the key cylinder had to be rather thin so that a good part of the key had to be exposed to be able to set the elements. The locks described in that patent required a separate mechanism to accomplish the key-isolation. In most cases this required a separate cylinder or gate, geared to the key cylinder.

In the present invention, the key isolation is accomplished in a far simpler and more novel manner.

SUMMARY OF THE INVENTION

In many conventional locks, a key is inserted into a cylinder. A set of tumblers is moved by the key into the desired positions so that the ends of the tumblers line up with the surface of the cylinder, thus permitting it to turn. It is important to note that in nearly all such locks each tumbler has to be matched to a particular cut in the key. In the usual case, a deep cut requires a long tumbler (or an appropriate section of the tumbler) while a shallow cut requires a short tumbler.

Such locks, in general, are easy to pick because the tumblers are accessable to a pick or other tool inserted into the key slot.

The locks of this invention differ from the prior art in the following basic way. The key enters a more-or-less conventional key cylinder. It positions a series of tumblers (preferably of the flat type) in a manner similar to that just described. When set by the key they do not line up with the surface of the key-cylinder, but project from it.

As the key is inserted, it is the tumblers that set a series of lock-opening elements that permit the lock to open. But before this last action can occur, the key-cylinder and its tumblers must be turned to a position that prevents any false key or a pick from reaching the elements either directly or by moving the tumblers.

Because the tumblers act only as intermediate members between the key and the lock opening (or lock locking) elements, I call these tumbers "transfer tumblers".

In the designs of this invention, it will be noted that the working portion of the key is completely enclosed in the key-cylinder at all times when the lock is operated. At no time is the key-slot open to permit an outside tool to reach from the key-slot to the lock controlling elements. This will become clear from the detailed description of the drawings.

DETAILED DESCRIPTION OF THE DRAWINGS

Figure 1:
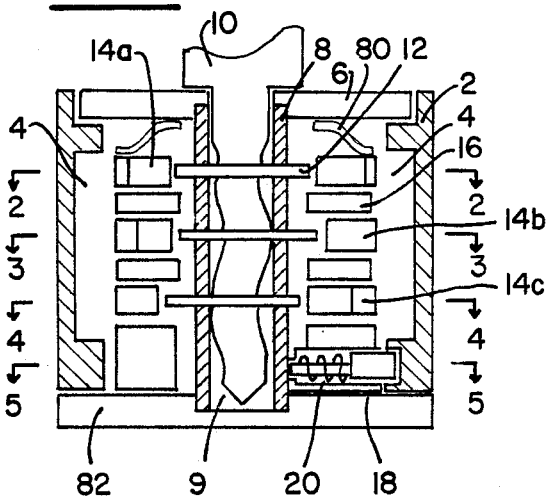
FIG. 1 shows the vertical section of one embodiment of my lock.

FIG. 1 shows a schematic diagram of the principal parts of one embodiment of my invention. The lock consists of an outside case 2 which may be a cylinder. The cylinder 2 is provided with at least two notches 4 and 4 that can also be seen in the section shown in FIGS. 2, 3 and others.

The outside cylinder 2 contains an inner main cylinder 6 arranged to rotate within it (2) for the lock to open or be closed.

Figure 2:
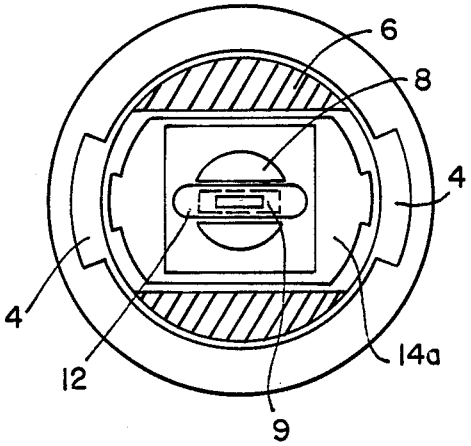
FIG. 2 shows a section of FIG. 1 taken approximately along line 2—2.

The inner cylinder 6 further contains a key-cylinder 8 also shown in the several section drawings, for example at 8 in FIG. 2.

A key cut on both edges, as will be explained below, is shown at 10 in FIG. 1. It fits into a full length slot 9 in the key-cylinder 8 as shown in FIG. 1, and as shown in dotted lines in FIG. 2.

Figure 11:
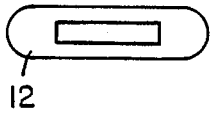
FIG. 11 shows a transfer tumbler.

The key-cylinder 8 is provided with a series (three in FIG. 1) of cross slots just large enough to permit the transfer-tumblers 12 to slide freely thru them. FIG. 11 shows one of these tumblers 12. In this embodiment the tumblers 12 are all identical and contain no information.

The reason for the key 10 being cut along both its edges is that is should be able to position tumblers 12 without the use of springs. It should be understood that the tumblers 12 are usually made of thin metal as compared to the width of the key 10.

In the plane of each tumbler (for example tumbler 12 in FIG. 1) there is located a sliding lock controlling element (for example element 14*a*.)

The spacers between these elements are shown at 16.

It will now be obvious that as the key 10 is inserted into the key-cylinder 8, the tumblers 12 will be shifted in their slots in the key cylinder 8. This motion will result in the positions shown in FIG. 2, 3, and 4. This would permit the cylinder 6 to turn except for one more provision.

At the bottom of the cylinder 6 there is a cam operated interlock generally labeled 18 (FIG. 1). Its operation was described in my U.S. Pat. No. 4,599,877 and a brief description will be repeated here.

Figure 5:
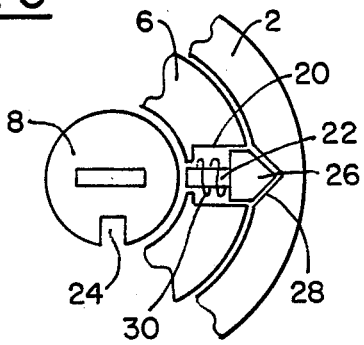
FIG. 5 shows a partial section of FIG. 1 taken along line 5—5. This section shows the details of an interlock that permits the inner main cylinder to revolve at the appropriate time.
Figure 9:
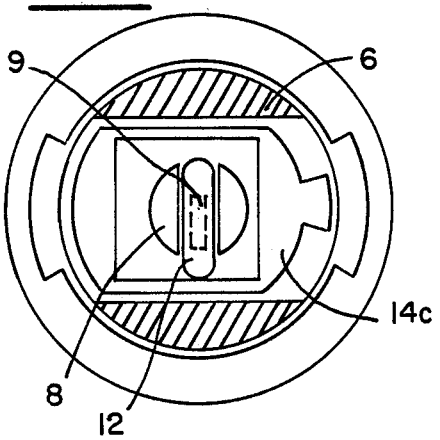
FIG. 9 shows a section of FIG. 1 taken along line 4—4 after the key has turned 90° from the position shown in FIG. 4.
Figure 10:
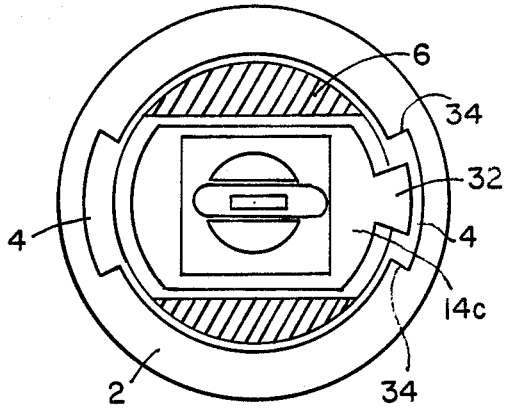
FIG. 10 shows the section of FIG. 4 except that an incorrect key has been inserted into the key cylinder.

The cylinder 6 has a passage hole 20 shown in FIGS. 1 and 5 for a pin 22 of the interlocking device 18. This pin 22 can enter the hole 24 in the key-cylinder 8 after it has been turned out of contact with the elements 14 (into the position shown in FIG. 9). When the lock is closed the pointed end 26 of the pin 22 is located in the notch 28 in the outer case 2 shown in FIGS. 1 and 5. When the key-cylinder 8 (FIG. 5) is turned 90 degrees counter clockwise (in FIG. 5), the hole 24 is opposite the pin 22 and the pointed end 26 is cammed out of the notch 28 against the force of the spring 30. This permits the inner cylinder 6 to turn and open the lock, provided the sliding elements 14*a*, 14*b* and 14*c* had been correctly set. If one or more of the elements had not been set correctly (as shown in FIG. 10) the cylinder 6 will turn thru a short angle until the end 32 of the element 14*c* (in FIG. 10) abuts one or the other wall 34 of the notch 4 in the outside case 2.

It will now be seen why I believe that this type of lock is pick-proof. In the final position of the key-cylinder 8, as shown in FIG. 9, there is no physical passage between the key slot 9 and the locking elements 14. The transfer tumbler 12 is still easily movable from the outside, but it does not contact the element 14*c*.

Figure 3:
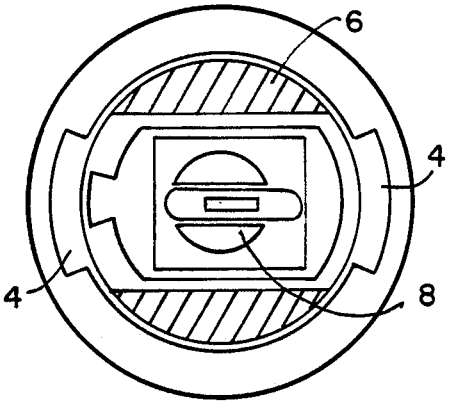
FIG. 3 shows a section of FIG. 1 taken approximately along line 3—3.
Figure 4:
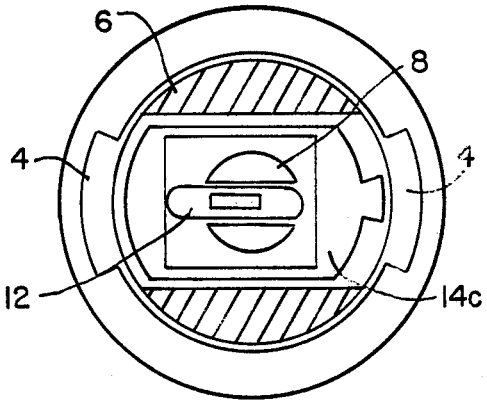
FIG. 4 shows a section of FIG. 1 taken approximately along line 4—4.

To close the lock, the cylinder 6 is rotated back to its start position as shown in FIGS. 2, 3, and 4, and the pin 22 snaps into the notch 28 (FIG. 5). This permits the key-cylinder 8 to rotate clockwise from the position shown in FIG. 9 to its starting position as seen in FIGS. 1 and 5. Now withdrawing the key 10 will move the transfer tumblers 12 into indefinite positions, depending on the shape of the key 10. This, in turn, will move the elements 14 from their lock opening positions and close the lock.

Figure 6:
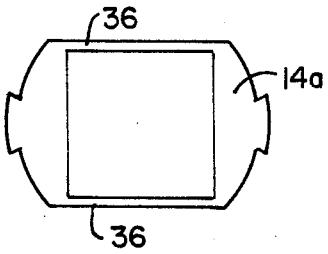
FIG. 6 shows a lock-opening element used in FIG. 2.
Figure 7:
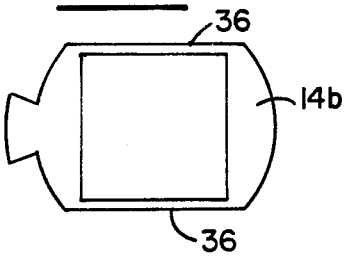
FIG. 7 shows a lock-opening element used in FIG. 3.
Figure 8:
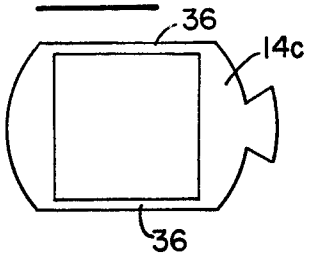
FIG. 8 shows a lock-opening element used in FIG. 4.
Figure 12:
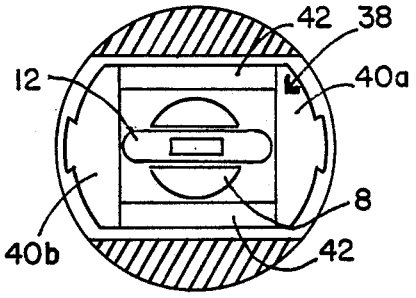
FIG. 12 shows a slightly different design of the lock-controlling element as would be used in the section of FIG. 2.
Figure 13:
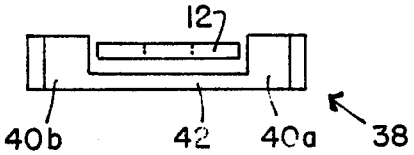
FIG. 13 is a side view of the different design of the lock-controlling element shown in FIG. 12.

It may have been noted in FIGS. 6, 7 and 8 that the elements 14*a*, 14*b* and 14*c* have rather narrow side strips 36. In order to make the elements more rugged, I show a modification in FIGS. 12 and 13. Here the element 38 is made in two levels. The end sections 40*a* and 40*b* are thicker, and the connecting sections 42 are thinner so that they do not contact the tumbler 12 when the key-cylinder 8 has been turned into the position shown in FIG. 9.

Figure 14:
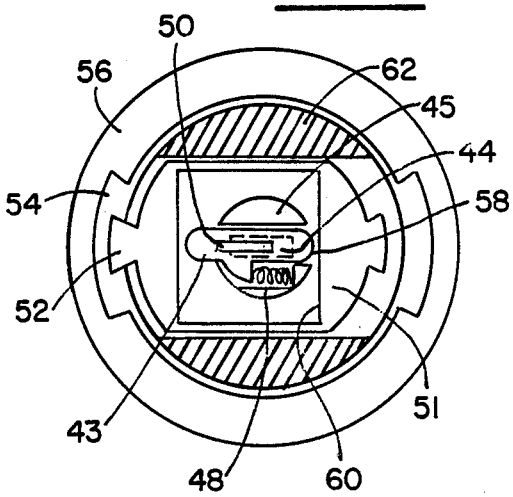
FIG. 14 shows a cross section taken of a different lock, where the tumblers are designed to be used with a key having bitting on one edge only. Each tumbler is kept in the position shown by a spring until moved by the key.
Figure 15:
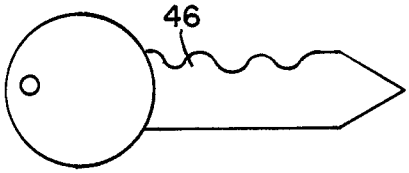
FIG. 15 shows the general design of a key to be used with the lock of FIG. 14.
Figure 16:
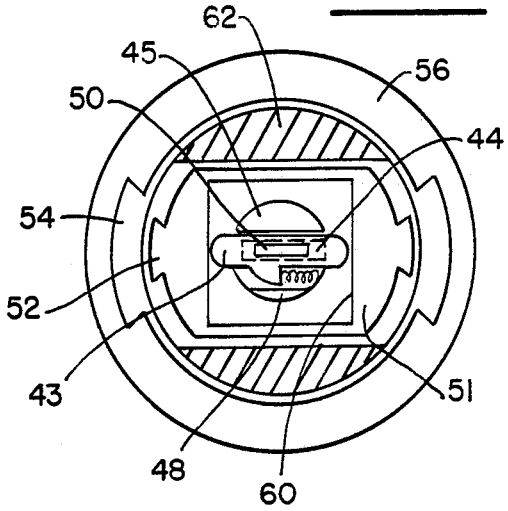
FIG. 16 shows the lock of FIG. 14 after a key has been inserted into its key-cylinder.

In FIGS. 14 and 16 I show a different embodiment of my invention. The operation of the lock of FIG. 14 is similar to that of the previously described embodiment except for the design of the key, (FIG. 15) the transfer tumblers 43, and the key cylinder 45.

Instead of the double ended tumblers shown in FIG. 11, I now use the spring operated tumbler 43 shown in FIGS. 14 and 16. The tumbler 43 is located in a slot in the key cylinder 45. While I show only one cross-section of the lock in FIG. 14, it should be understood that, as in the previous embodiment, there are several such layers. All of the tumblers 43 in the several layers may be alike, as formerly. The key 46 (shown in FIG. 15) is different in that it is cut only along one edge. This key 46 is of a type used today in a great many locks.

Because of the single bitted key 46, the tumblers 43 have to be pressed against the key by springs. One such spring 48 is shown in FIGS. 14 and 16.

The slot 50 in the tumbler 43 is shown in FIGS. 14 and 16 and is located centrally in the tumbler. The key slot 44 in the cylinder 45 is wider, as indicated by the dotted lines. The key slot 44 extends thruout the length of the key-cylinder 45. As the key 46 is inserted into the key-cylinder 45, the various tumblers are pushed out against the forces of their springs like that shown for the one tumbler 43.

Located co-planar with the transfer tumblers 43 are a series of lock-opening elements 51. Their function is exactly the same as the function of the lock elements 14 of FIG. 1.

When the element 51 is in the position shown in FIG. 14, the lock is closed because the projection 52 of the element 51 is in the notch 54 in the outer casing 56.

Assume now that a key, like 46 in FIG. 15, is inserted into the key cylinder 45. As shown in FIG. 16 this will push the tumbler 43 out some required distance. This will make the outside end 58 of the tumbler 43 (FIG. 14) act against the surface 60 of element 51 and push it into the position shown in FIG. 16. In this position, the projection 52 is withdrawn from the notch 54 in the outer casing 56, and the element 51 will permit the cylinder 62 to turn.

As the key cylinder 45 is turned 90° counter clockwise, the key cylinder 45, the key 46, the key slot 44 and the tumbler 43 are isolated from the element 51 making this lock impossible to be picked by inserting any type of tool into the key-slot 44.

This lock is also provided with a pin interlock exactly such as shown in FIG. 5. This pin interlock locks the key cylinder 45 to the inner cylinder 62 of the lock exactly as it did in FIG. 1. Specifically, it locks the key-cylinder 45 to the cylinder 62 while, at the same time permitting the cylinder 62 to rotate and open the lock, provided that the elements 51 had been correctly set.

When it is desired to close the lock, the cylinder 62 is rotated clockwise by the key 46. When the cylinder 62 reaches the position shown in FIG. 14, the interlocking pin 22 (FIG. 5) snaps back so that its end 26 is again in the notch 28 in the outside case.

This releases the interlock between the cylinder 62 and the key-cylinder 45. The key-cylinder 45 can continue to rotate clockwise to a position like that shown in FIG. 5.

The lock is now closed. The key 46 can be withdrawn from the key cylinder 45 and the components will be as shown in FIG. 14.

I have stated that the transfer tumblers in two embodiments so far described can be all alike. If the tumblers of a lock are of all alike they, of course, carry no information and the information carried by the bitting of the key has to be matched by the information contained in the shape of the locking elements such as 14 in FIG. 1, or 51 in FIG. 14.

Figure 17:
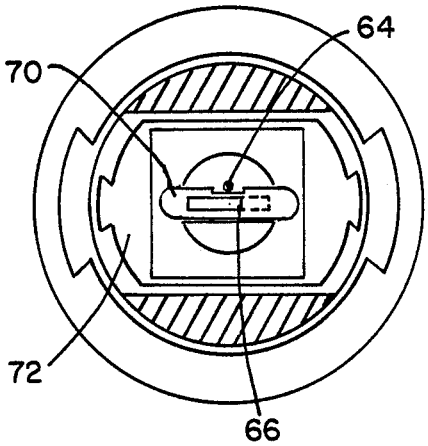
FIG. 17 shows a section of a third embodiment of my invention. Here the transfer tumblers set by a key are not identical. Their central slot is located in different positions.
Figure 18:
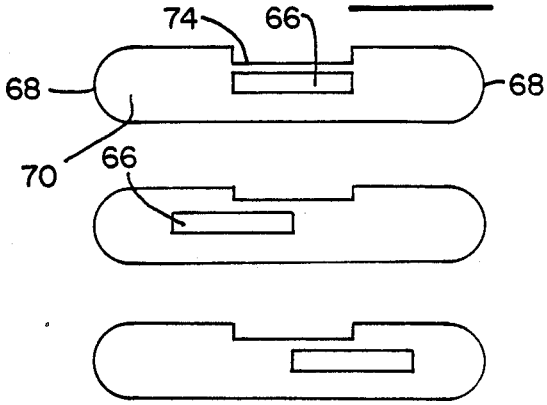
FIG. 18 shows three different tumblers for this third embodiment.

It is entirely possible, however, to use transfer tumblers that differ from each other and make the locking element all alike such as I show in FIGS. 17 and 18. Here the transfer tumblers 70 are made to correspond to the bitting of the key 10 in FIG. 1. The central openings 66 must fit the key, but are located at different position relative to the outer ends 68 (FIG. 18).

As the key is inserted into a lock with such tumblers (as in FIG. 17) their ends 68 can all align in two straight lines. The locking elements 72 being all alike (like that in FIG. 17) now will be forced to also align themselves and the lock will open. The position of all the elements of the lock will be like the element 72 of FIG. 17.

Please note that the alignment of the transfer tumblers 70 in this embodiment is similar to the alignment of tumblers in millions of locks used to-day, except that in the usual locks the ends of the tumblers themselves permit the locks to open while in my lock the tumblers 70 transfer their positions to another set of elements 72 that control the opening and closing of the lock.

Because tumbler 70 (in FIGS. 17 and 18) contains information as to the bitting of the key, I provide a motion limiting pin 64 that co-acts with the notch 74 (in FIG. 18) in the tumbler 70. This permits the tumbler 70 to move under the action of the key, but prevents a lock picker from "feeling" the relationship of the slot 66 to the ends 68 of each tumbler 70.

The single bitted key of FIG. 15 can also use tumblers with slots in different positions and elements 51 of identical shape (FIG. 14).

It should also be now obvious that a lock can have only some of its tumblers of one fixed design and some of elements of different shapes. The rest of the tumblers can be of different designs and the elements co-operating with them are of one design.

It is even possible to design such a lock with transfer tumblers of random designs, as compared to the bitting of the key, and have the locking elements of correct corresponding shapes. Thus each tumbler and its locking element, together, will match the information contained in a single bit of the key.

While I show three different embodiments of my invention that use sliding locking elements, there are other possibilities. For example, the sliding elements, such as **14*a* in FIG. 2, and 51 in FIG. 14**, can be replaced by rocking elements, and the key cylinder with its projecting transfer tumblers can operate against the surfaces of the rocking locking elements, such as the elements 4 in FIG. 8 of U.S. Pat. No. 4,599,877.

The basic design of enclosing the functioning section of a key totally inside a member of a lock, and operating the lock mechanism via set of transfer devices is the essence of this invention. The key containing member, and the transfer elements comprise the key isolating mechanism that is new as compared to the separate key isolating devices described in my U.S. Pat. No. 4,599,877.

In FIG. 1 I show a spring 80 that presses all the elements 14 together and against the base 82 of the cylinder 6 so that gravity and vibration effects will not move the elements 14 after they had been set correctly by the key 10, and after the key 10 and tumblers 12 have been isolated from them. The spring 80 presses against the element **14*a* and this pressure is transmitted through all the elements 14 and the spacers 16** to accomplish the desired result.

For the sake of clarity, I do not show many usual mechanical components in my drawings. I do not show support components, fasterners, rotation stops and other such parts. Such mechanical features are old in the art and need not be illustrated here.

The invention may be used as locks for such things as doors, file cabinets, safes and other devices where two mechanical parts are held in a predetermined relative position when the lock is locked, but may also be used for any other application where a key, if a correct one, operates a device. For example, it is very common to use a lock to close or open an electrical circuit when the correct key operates the lock.

I claim to have invented:

1. In a lock and key combination:

an outer member, and an inner member rotatable with reference to the outer member to open the lock, rotatable means for receiving said key and being rotated thereby, first and second locking means for locking said inner member to the outer one to thus prevent the lock from being unlocked, said first locking means locking said inner and outer members together until said key has rotated said rotatable means at least a given angular amount, said second locking means comprising a portion of said inner member movable along a diameter of its path of rotation, said second locking means locking said inner and outer members to prevent relative rotation thereof except when said portion is in one particular position in its path of motion along said diameter, said inner member being rotatable with respect to said outer member to unlock the lock when said portion is in said particular position and said rotatable means has rotated at least said given angular amount, said portion being positioned along said diameter by the key.

2. In a lock and key combination as defined in claim 1:

a slidable element movable along said diameter, by the key, and under control of the key, for positioning said portion along said diameter.

3. In a lock and key combination as defined in claim 2:

said slidable element being a part of said rotatable means and angularly movable therewith.

4. In a lock and key combination as defined in claim 1:

said outer member having an inner surface defining a notch, said first locking means comprising a pin having a forward tapered end biased into said notch, said pin being mounted in said inner member, said rotatable member having an opening therein which the pin may enter when said rotatable means has rotated said given angular amount, so that when said portion is in said particular position along said diameter said inner member and said rotatable means may be rotated relative to said outer member causing said pin to leave said notch and enter said rotatable means.

5. In a lock and key combination as defined in claim 4 in which said rotatable means includes means for engaging said inner member to move it relative to said outer member after said rotatable means has rotated said given angular amount.

6. In a lock and key combination as defined in claim 5:

a slidable element movable along said diameter, under the control of said key, for positioning said portion along said diameter, said slidable element being a part of said rotatable means and angularly movable therewith.

7. In a lock:

lock opening means for introducing information into said lock, first and second members movable with reference to each other to open the lock, information receiving means for receiving information from said lock opening means and movable thereby, first and second locking means for locking said members together to prevent relative movement thereof, said first locking means locking said first and second members together to prevent relative movement thereof except when said information receiving means has been moved in a predetermined manner by said lock opening means, said second locking means comprising a third member movable along a path for locking said first and second members together and preventing said relative movement except when said third member is in a particular position, along its path of movement said first and second members being arranged for relative movement to unlock the lock when said information receiving means was moved in said predetermined manner by said lock opening means and said third member is in said particular position, said third member being positioned by said lock opening means, whereby when the lock opening means feeds correct information into the lock the said third member may be moved to said particular position.

8. In a lock as defined in claim 7, said lock opening means comprising a key.

9. In a lock and key combination as defined in claim 7:

a slidable element positioned by said key for positioning said third member in said particular position when the correct key is inserted in said key receiving means and said third member is positioned to block relative movement of said first and second members when an incorrect key is inserted in said key receiving means.

10. In a lock and key combination:

an outer cylinder, an inner cylinder mounted for rotation in said outer cylinder, said lock being locked when said cylinders are in one relative angular position and being unlocked when in another relative angular position, said inner cylinder having a plurality of members parallel to each other and extending across a diameter of said inner cylinder, at least one of said plurality of members engaging said outer member to block relative movement of said inner and outer cylinders unless each of said members is in a predetermined position along said diameter, said inner cylinder having a central cavity, a key receiving rotatable member coaxial with said inner and outer cylinders and located in said central cavity, slidable members mounted on said rotatable member, there being one slidable member for each of said plurality of members, said slidable members being positioned along said diameter and each slidable member positioning its complementary one of said plurality of members in its predetermined position when the correct key is inserted in said key receiving means, said outer cylinder having a notch therein, a pin passing through said inner cylinder and into said notch, said pin and notch being shaped to cause said pin to be ejected from the notch by relative movement of said cylinders, means for biasing said pin into said notch, said pin being held in said notch by said key receiving means, said key receiving means having an opening therein for receiving said pin when said key receiving means has rotated a given angular amount, said inner and outer cylinders being movable with respect to each other to open the lock when the correct key sets said members and said key receiving means has rotated at least said given amount so as to allow rotation of said inner cylinder relative to the outer one to force said pin out of said notch and into said key receiving means.

11. In a lock and key combination according to claim 10:

said outer cylinder defining indents at opposite ends of said diameter so that if any one of said plurality of members is not in its predetermined position it will extend into one of said indents and prevent sufficient relative movement of said cylinders to allow the lock to open, each of said plurality of members being inaccessible to a lock picking tool when said pin is out of said notch.

said indents being so wide that said plurality of members will not touch the outer cylinder as long said said pin is in said notch; whereby to impair any attempt to pick the lock.

12. In a lock and key combination as defined in claim 10:

said rotatable means and said inner cylinder having means for rotating the inner cylinder by said rotatable means when the rotatable means rotates beyond said given angular amount.

13. In a lock:

lock opening means for feeding information into said lock, an outer cylinder, an inner rotatable means having a first slidable element which may slide along one of its diameters and which prevents rotation of said inner rotatable means relative to said outer cylinder unless said first slidable element is in one particular position along said diameter, said inner cylinder being rotatable relative to the outer cylinder when said element is in said particular position, and a rotatable second slidable element which may be positioned to slide along said diameter, said lock opening means feeding information into said lock in order to change the position of said second slidable element along said diameter, said second slidable element when positioned to slide along said diameter while engaging said first slidable element positioning said first slidable element along said diameter in accordance with the information fed into said lock by said lock opening means.

14. In a lock as defined in claim 13, said lock opening means comprising a key.

15. In a lock as defined in claim 13, said second slidable element being rotatable to an angular position at which it no longer moves said first slidable member along said diameter.

16. A lock as defined in claim 15 including means for preventing relative motion of said inner rotatable member and said outer cylinder, until said second slidable member has been rotated from a position along said diameter to a different angular position.

17. In a mechanical lock and key combination, a first member, a second member movable in a first direction relative to said first member to open the lock and including blocking means movable in a second direction relative to said first member to prevent relative movement of said first and second members, said blocking means having a position in which it does not prevent relative movement of said first and second members, a third member for receiving a portion of the key, said portion of the key containing information required to open said lock and for setting said third member in a position representative of said information, said third member setting said blocking means in said position in which it does not prevent relative movement of said first and second members, said third member being movable relative to said second member after said blocking means is in said position in which it permits relative movement of said first and second members, to thereby isolate said key from said blocking means, thereby impairing any effort to pick the lock.

18. In the mechanical lock and key combination of claim 17:

interlock means for preventing movement of said second member relative to said first member in said first direction until said third member has moved to isolate said key from said blocking means.

19. In a lock and key combination:

at least three members movable with respect to each other, the first and second members being movable relative to each other to open and close the lock, the third member having a plurality of movable first elements, a plurality of movable second elements, one complementary to each movable first element, mounted on said second member; each said second element being movable by its complementary movable first element, said lock including key receiving means for receiving the key and setting said movable first elements to positions determined by the shape of the key, any of movement of any said first elements while it is being set by said key being communicated to the movable second element which is complementary to such movable first element, said third member being movable for at least a prescribed amount relative to second member after said elements have been set by said key, to thereby move said first elements to positions at which they no longer can move said second elements, said second elements when set by a correct key moving each of said first elements to its prescribed position to permit the lock to be opened.

20. In the lock and key combination of claim 19:

means for blocking relative movement of said first and second members until said third member has moved at least said prescribed amount.

21. In the lock and key combination of claim 19:

said key receiving means and said first elements defining a passage that is sufficiently closed so that a lock picking instrument cannot readily enter said key receiving means and set said second elements.

22. In a lock and key combination:

key receiving means having an opening for receiving a key, a plurality of movable first elements each of which is set to a particular position by the correct key, a plurality of movable second elements including one for each first element and which is complementary to its corresponding first element, each of said second elements being set by its complementary first element when such first element is set by said key, and manually movable means for isolating said opening from said second elements to thereby substantially prevent picking of the lock and for unlocking the lock after such isolation has been effected if said second elements have been set by a correct key.

23. In the lock and key combination of claim 22, said manually movable means moving said first elements to positions where they no longer can set said second elements when said manually movable means is moved to isolate said opening from said second elements.

24. In a lock and bitted key combination:

first, second and third relatively movable members, said first and second members being rotatable relative to each other in order to open the lock, said third member having guiding means and a passageway, a plurality of primary tumblers each guided by said guiding means and having a passageway cooperating with the passageway in said third member for receiving a key, each of said primary tumblers having a complementary bit on a correct key and being positioned by its complementary bit of said key, said third member being mounted for rotation so that the key may rotate it and so that said guiding means rotates said primary tumblers when the key rotates said third member, said second member having guiding means, a secondary tumbler for each primary tumbler, each said secondary tumbler being guided by the guiding means of said second member, each secondary tumbler being positioned by its complementary primary tumbler so that unless the tumblers are set by a correct key at least one secondary tumbler will operatively engage said first member to prevent relative movement of said first and second members and prevent the lock from opening, said primary and secondary tumblers being shaped so that when said third member is rotated at least a given amount the primary tumblers move out of operative contact with the secondary tumblers leaving the secondary tumblers in the positions in which they were set by the primary tumblers when the primary tumblers were set by the key, and means that normally blocks relative movement of said first and second members to prevent the lock from opening but which no longer blocks such relative movement after said third member has been rotated by at least a given angular amount, said given angular amount being sufficient to move said primary tumblers out of operative contact with said secondary tumblers, said lock being enabled to open when the correct key has set said primary tumblers which in turn have set said secondary tumblers and said key has rotated said primary tumblers by at least said given angular amount.

25. In the lock and key combination of claim 24:

each said primary tumbler and its complementary secondary tumbler being flat plates movable in a common plane, said key being a double bitted key, each of said primary tumblers being identical with the other primary tumblers so that the passageway of each primary tumbler is of identical size and location as the size and location of the passageways of the other primary tumblers, said passageways of said primary tumblers having a given length equal to the distance between two complementary tips of the double bitted key.

26. In the lock and key combination of claim 24:

said key being a single bitted key with a bit for each primary tumbler, and spring means for biasing said primary tumblers to provide contact between each said primary tumbler and its complementary bit of said key.

27. In the lock and key combination of claims 24:

said passageways in the tumblers also being elongated, said primary tumblers being elongated with the elongated passageways of different primary tumblers being located at different distances along the length of the primary tumblers.

* * * * *